US005944028A

United States Patent [19]

Gebhard

[11] Patent Number: 5,944,028

[45] Date of Patent: Aug. 31, 1999

[54] HEATED EYELASH CURLER

[76] Inventor: Albert W. Gebhard, 2101 Alameda Ave., Denver, Colo. 80209

[21] Appl. No.: 09/250,191

[22] Filed: Feb. 16, 1999

[51] Int. Cl.[6] ..... A45D 40/30; A45D 2/48; A45D 1/04; A45D 26/00

[52] U.S. Cl. ..... 132/216; 132/217; 219/222; 219/225; 219/223

[58] Field of Search ..... 132/218, 216, 132/217; 219/223, 225, 222

[56] References Cited

U.S. PATENT DOCUMENTS

| | | | |
|---|---|---|---|
| 1,925,266 | 9/1933 | Manning | 132/217 |
| 3,382,876 | 5/1968 | Spier . | |
| 3,525,347 | 8/1970 | D'Elia | 132/31 |
| 3,838,699 | 10/1974 | Skandalakis | 132/217 |
| 4,212,311 | 7/1980 | del Valle | 132/31 |
| 5,590,669 | 1/1997 | McMullen | 132/217 |
| 5,704,377 | 1/1998 | McMullen | 132/217 |

*Primary Examiner*—John J. Wilson
*Assistant Examiner*—Trang Doan
*Attorney, Agent, or Firm*—Patent Law Offices of Rick Martin, P.C.

[57] ABSTRACT

The invention comprises an electric eyelash curler. The invention has a handle connected to a head assembly. The head assembly comprises a heat element, gap and clamp surface. The heat element circuit is contained within the handle. A user places her eyelash into the gap. The user then presses on a lever, which moves the heat element into contact with the clamp surface. Movement of the lever also activates the heat element electric circuit. The heat element is turned "on", thereby heating and curling a user's eyelash. An audio signal or tone sounds once the proper amount of time has passed. In an alternate embodiment, the heat element is automatically de-activated when the tone sounds. Once complete, the user releases the pressure on the lever, thereby releasing her eyelash and de-activating the heat element circuit. A light is included to illuminate the user's eyelash.

20 Claims, 3 Drawing Sheets

HEATED EYELASH CURLER

FIELD OF THE INVENTION

The field of the present invention relates to cosmetic devices, more particularly to eyelash curlers having an electrically heated element to curl an eyelash by the application of heat.

BACKGROUND OF THE INVENTION

Persons have used various devices to make themselves more attractive. The face receives much attention with respect to cosmetics and treatments designed to improve one's appearance. In particular, the practice of curling one's eyelashes is widely recognized. Various eyelash curlers have been employed over the years. They generally comprise mechanical devices used to compress the eyelash between two curved members whereby the eyelash is mechanically given a set or curl. Others use a heated element to further augment the curling process. Generally, the heating element used to heat the curling surface(s) is remote from the curler surface(s). The prior art devices all require the user to hold the device on the eyelash for an indeterminate length of time in order to properly curl the eyelash. When a user curls the eyelash, the user covers the eye and casts a shadow across the eye area, making viewing of the curling process by a user difficult. The prior art does not provide a light to more easily view the eyelash area.

Representative of the art is:

U.S. Pat. No. 5,704,377 (1998) to McMullen discloses a system for remotely heating an eyelash curling device which is designed to heat a flexible compression strip of the device without heating the blade or rest of the eyelash curler which is adapted so that the compression is maintained within the desired temperature range for a larger period of time when disengaged from the remote heating apparatus and has one or more features for activating the remote heating apparatus.

U.S. Pat. No. 5,590,669 (1997) to McMullen discloses a system for remotely heating convention eyelash curling device which is designed to heat a flexible compression strip of the device without heating the blade or rest of the eyelash curler.

U.S. Pat. No. 4,212,311 (1980) to del Valle discloses a manually operable eyelash curler which uses a battery pack to provide the electrical energy to heat the electrically heated eyelash compressing element.

U.S. Pat. No. 3,525,347 (1970) to D'Elia et al. discloses an eyelash curler comprising a body provided with a convex surface with a chamber in alignment with the convex surface and heating means being provided.

U.S. Pat. No. 3,382,867 (1968) to Spier discloses an improved device for artificial eyelash curlers which is structurally compact and lightweight making it convenient to be carried in a purse.

EP Pat. No. 272,034 (1988) to Suzuki discloses an eyelash curler with upper and lower nipping jaws and a heater provided.

AU Pat. No. 622,876 (1949) to Benoit discloses a device with means for curling eyelashes which is heated internally.

What is needed is an eyelash curler that is electrically heated. What is needed is an eyelash curler that has light. What is needed is an eyelash curler that has an audio signal. The present invention meets all these needs.

SUMMARY OF THE INVENTION

The primary aspect of the present invention is to provide an eyelash curler that has electrically heated curling members.

Another aspect of the present invention is to provide an eyelash curler that has a light.

Another aspect of the present invention is to provide an eyelash curler that has an audible signal.

Another aspect of the present invention is to provide an eyelash curler having a circuit that de-activates a heat element after a pre-determined length of time.

Other aspects of this invention will appear from the following description and appended claims, reference being made to the accompanying drawings forming a part of this specification wherein like reference characters designate corresponding parts in the several views.

The invention comprises an electric eyelash curler. The invention has a handle connected to a head assembly. The head assembly comprises a heat element, a gap and a clamp surface. The heat element circuit is contained within the handle along with the batteries. A user places her eyelash into the gap. The user then presses on a lever, which moves the heat element into contact with the clamp surface. Movement of the lever also activates the heat element electric circuit. The heat element is then "on", heating and curling a user's eyelash. An audio signal sounds once the proper amount of time has passed. Once complete, the user releases the pressure on the lever thereby releasing her eyelash and de-activating the heat element circuit. A light is also included to illuminate the user's eyelash.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE PREFERRED EMBODIMENT

Figure 1:
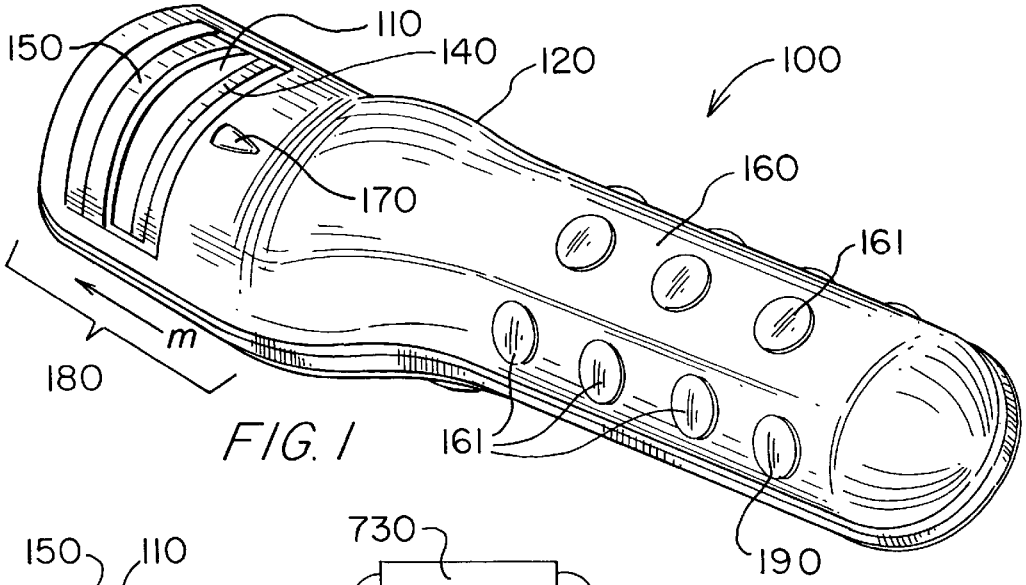
FIG. 1 is a top perspective view of the preferred embodiment.

FIG. 1 is a top perspective view of the preferred embodiment of heated eyelash curler 100. Handle 160 is combined with neck 120. Head assembly 180 is connected to handle 160 with neck 120 at a predetermined angle $\alpha$, shown in FIG. 3, which is in the range of 5 degrees to 40 degrees. The invention 100 is of length L such that it may be comfortably manipulated by a user. Handle 160 further comprises a plurality of relief bumps 161 for a better grip on the invention by a user. Head assembly 180 comprises heat element 140, clamp surface 150 and gap 110. Heat element 140 and clamp surface 150 comprise a non-stick material, including plastic and Teflon®. Heat element further comprises a silicon block with an elecrically resistant wire element, for example, a Nichrome® wire. Gap 110 is closed by pressing heat surface 140 against clamp surface 150. Movement of heat surface 140 is accomplished by a user pressing her thumb against lever 130, shown in FIG. 3, thereby pushing heat element 140 in the direction M. Lever 130 is mechanically connected to heat surface 140.

Figure 10:
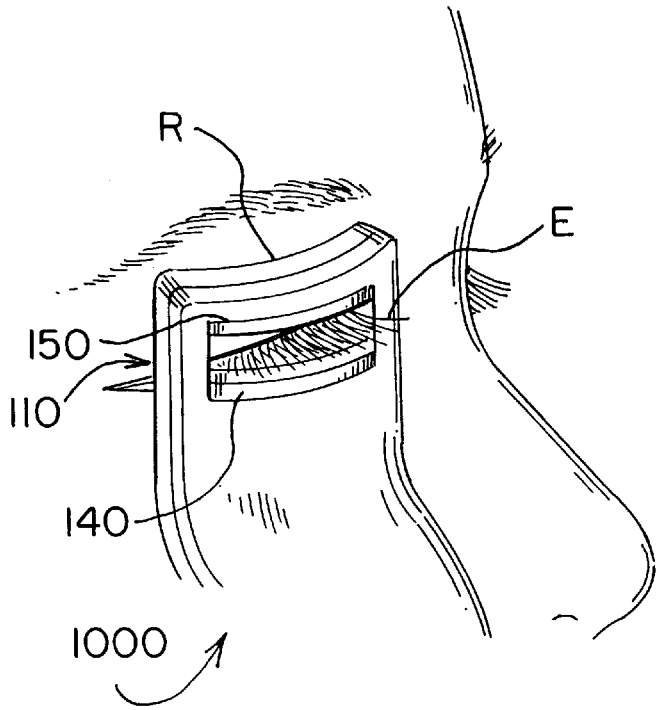
FIG. 10 is a perspective view of the invention in use on a user's eyelash.

In use, a user orients the invention so that an eyelash is placed into gap 110. The user then presses lever 130 with her thumb to clamp the eyelash between heat element 140 and clamp surface 150. Clamp surface 150 further comprises a convex surface 151 that cooperates with a concave surface 141 on heat surface 140, as shown in FIG. 10. As will be described in the following figures, movement of lever 130 activates a heating circuit, see FIG. 7, thereby activating heat element 140. Heat element 140 is heated to a temperature in the range of 100° F. to 120° F. Circuits for heating an element to a pre-determined temperature and maintaining such temperature are well known in the art. Activation of heat element 140 with the eyelash clamped between the heat element 140 and clamp surface 150 applies heat to a user's eyelash, resulting in the eyelash being curled. Upon movement of lever 130, an audio signal will also be generated by an electronic circuit, see FIG. 7, which sounds from audio port 190 after a predetermined time period has expired. Once complete, the user simply withdraws her thumb thereby opening gap 110 and disabling the heating circuit. Although the foregoing description describes a particular arrangement and location of the heat surface 140, it is also acceptable for the clamp surface 150 to be the heat surface. The invention will function in either mode.

Figure 2:
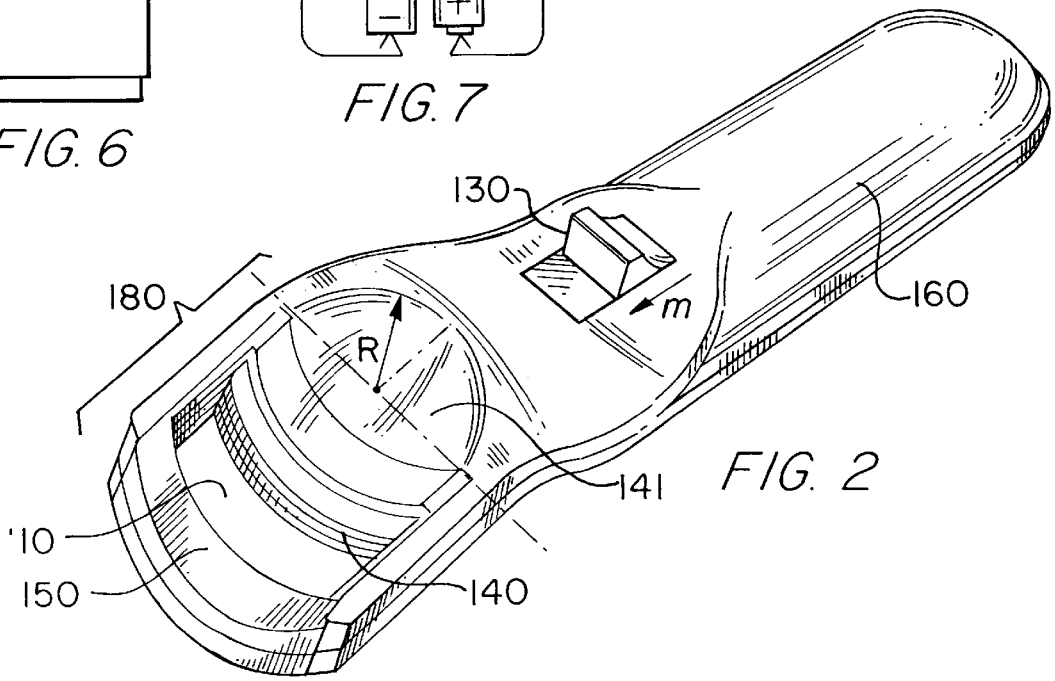
FIG. 2 is a bottom perspective view of the preferred embodiment.

FIG. 2 is a bottom perspective view of the preferred embodiment. Handle 160 is shown connected to head assembly 180 at neck 120. Lever 130, described in FIG. 1, is pushed in direction M by a user. Lever 130 is mechanically connected to heat surface 140. Movement of lever 130 causes heat surface 140 to move toward and to contact clamp surface 150. Heat surface 140 and clamp surface 150 describe a radius R such that a users eye and eyelash can be comfortably inserted into gap 110. Head assembly 180 also describes a spherical recess, also having radius R, cooperating with the radius of heating surface 140 in order to comfortably accommodate a user's eye and eyelash.

Figure 3:
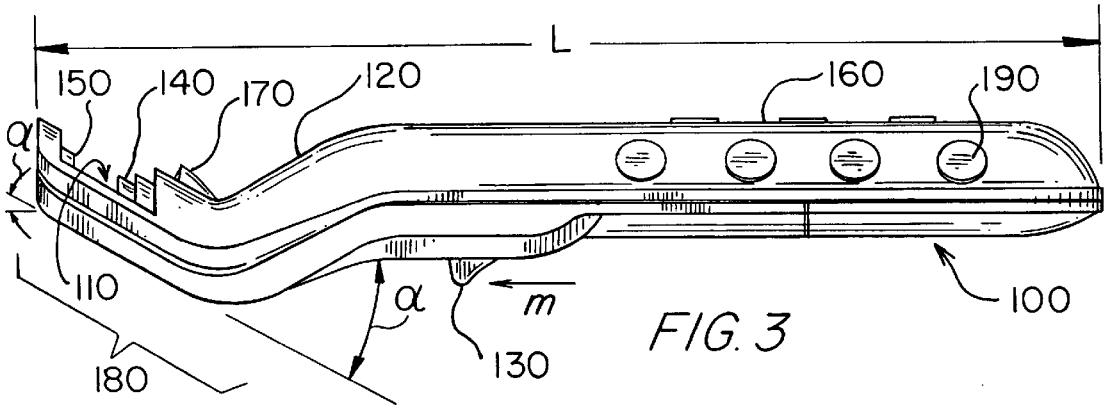
FIG. 3 is a side elevation view of the preferred embodiment.

FIG. 3 is a side elevation view of the preferred embodiment. Light 170 is attached to an upper surface of neck 120, thereby providing light to what is usually a dim area. Light 170 is illuminated upon movement of lever 130. Head assembly 180 is attached to neck 120 at an angle $\alpha$ compared to a center axis of handle 160.

Figure 4:
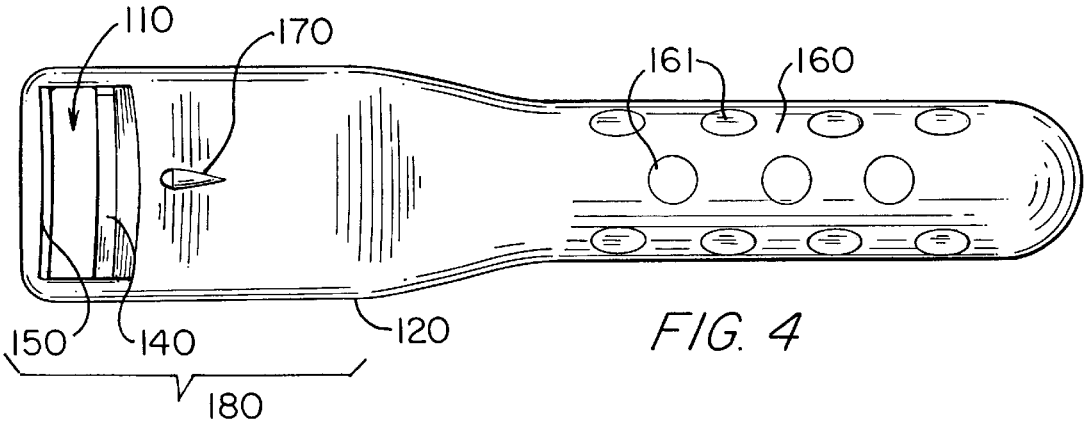
FIG. 4 is a top plan view of the preferred embodiment.

FIG. 4 is a top plan view of the preferred embodiment. Light 170 is aligned substantially along a central axis of handle 160.

Figure 5:
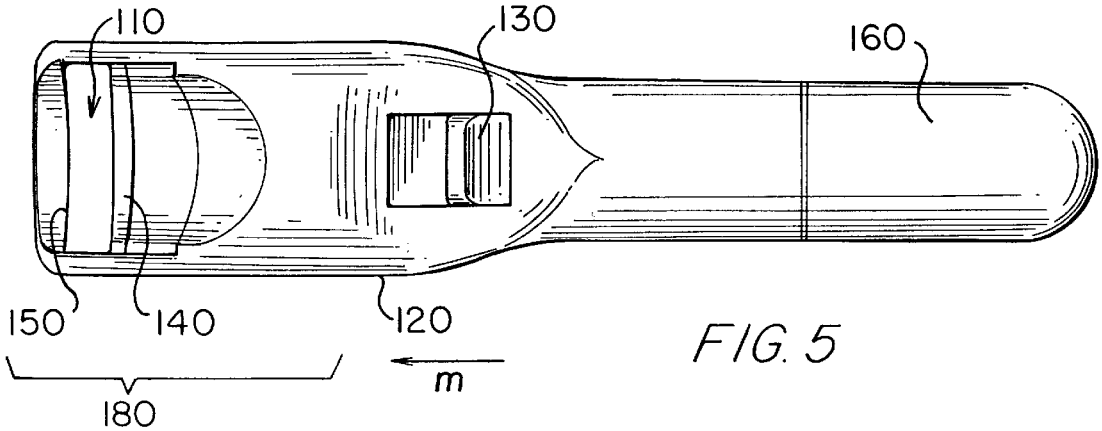
FIG. 5 is a bottom plan view of the preferred embodiment.

FIG. 5 is a bottom plan view of the preferred embodiment. Lever 130 is moved by a user's finger in direction M.

Figure 6:
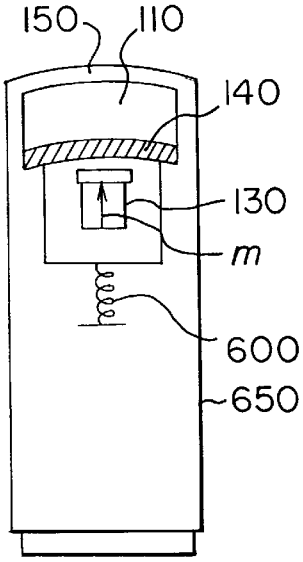
FIG. 6 is a mechanical schematic view of the heating surface.

FIG. 6 is a mechanical schematic view of the heating surface. Spring 600, having a spring constant k, is connected to lever 130 such that it resists movement of lever 130. By pressing on lever 130 a user moves heat surface 140 in a direction M. Movement of heat surface 140 closes gap 110 causing heat surface 140 to press against clamp surface 150. Once complete, a user releases the pressure on lever 130, whereby spring 600 retracts heat element 130, thereby disengaging the heat element from a user's eyelash.

Figure 7:
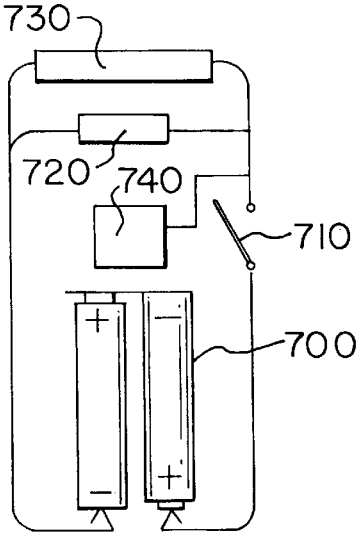
FIG. 7 is an electrical schematic drawing of the preferred embodiment.

FIG. 7 is an electrical schematic drawing of the preferred embodiment. A battery or batteries 700 are connected in series with switch 710 and heat element 730. In the preferred embodiment batteries 700 are contained within handle 160. Heat element 730 is contained within heat surface 140 or it, in and of itself, comprises heat surface 140. Light 720 is connected in parallel with heat element 730. Switch 710 is closed when a user presses lever 130 (shown in FIG. 1), pressing heat element 730 against clamp surface 150 (shown in FIG. 1). Battery 700 is known in the art and is in the range of 3 to 12 volts. A single battery or a plurality of batteries may be used. The batteries may be disposable or rechargeable. Timer circuit 740, known in the art, is activated once switch 710 is closed. Timer circuit 740 allows a pre-determined amount of time to pass, at which time an audible tone is emitted by the timer circuit. The pre-determined amount of time may range from 1 second to 10 seconds. The tone signals a user that a sufficient amount of time has passed to achieve the desired result of setting a curl in the user's eyelash. The tone sounds for a short length of time, in essence a "beep", and then falls silent. Opening switch 710 at the end of use resets the timer/audio circuit. In an alternate embodiment, timer circuit 740 automatically de-activates the heat element at the same time the audible tone sounds. In yet another alternate embodiment, the invention is powered by a 120V wall connection fed through a step down transformer, known in the art, contained with the handle (not shown) to reduce the voltage to the range of 3 to 12 volts.

Figure 8:
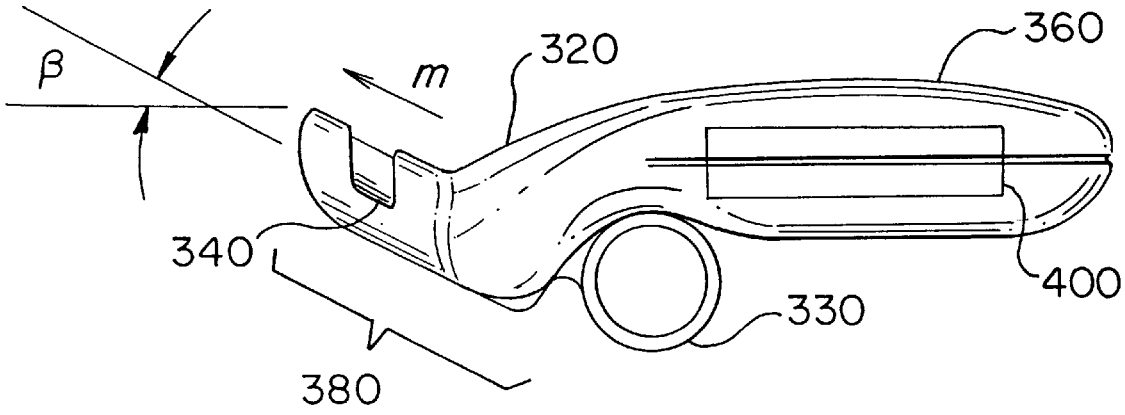
FIG. 8 is a perspective view of an alternate embodiment.

FIG. 8 is a perspective view of an alternate embodiment. Handle 360 is combined with neck 320. Head assembly 380 is attached to handle 360 at neck 320. Head assembly 380 comprises heat element 340, clamp surface 350 and gap 310. Gap 310 is closed on a user's eyelash by pressing heat surface 340 against clamp surface 350. Movement of heat surface 340 is accomplished by a user placing a finger through loop 330. Loop 330 is mechanically connected to heat element 340. Pulling on loop 330 causes heat element 340 to move in the direction M, as described for the preferred embodiment.

Figure 9:
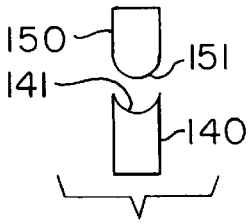
FIG. 9 is a side elevation view of the heat surface and the clamp surface.

FIG. 9 is a side elevation view of the heat surface and the clamp surface. Convex surface 151 cooperates with concave surface 141. Concave surface 141 moves in direction M to contact convex surface 151. When the surfaces are clamped together, they result in the eyelash of the user being curled in an upward direction as compared to a user's face, FIG. 10 is a perspective view of the invention in use with a user's eyelash. Eyelash curler 1000 is shown with the eyelashes E of a user inserted into gap 110 in anticipation of closure of the heat surface 140 against clamp surface 150.

Although the present invention has been described with reference to preferred embodiments, numerous modifications and variations can be made and still the result will come within the scope of the invention. No limitation with respect to the specific embodiments disclosed herein is intended or should be inferred.

I claim:

1. An eyelash curler comprising:

a handle connected to a head assembly;

said head assembly comprising a heat surface and a clamp surface, said heat surface having a concave surface and said clamp surface having a convex surface cooperating with said concave surface in order to receive an eyelash therebetween;

said heat surface and said clamp surface further describing a curve having a radius R, said radius oriented such that a concave aspect of said curve is directed toward a user's eyelash;

a lever contained within said handle and connected to said heat surface;

said heat surface moveable from an open position to a clamped position by application of a pressure by a user to said lever, whereby said lever is moved and said convex surface is pressed against said concave surface;

said heat surface further comprising a heat element circuit connected to said lever and to a power source; said power source contained within said handle; and said heat element circuit activated by movement of said lever, wherein said heat surface is heated to a predetermined temperature.

2. The eyelash curler as in claim 1 further comprising:

a light attached to said handle and adjacent to said head assembly, directed toward said head assembly;

said light being electrically connected to said power source; and said light being activated upon a movement of said lever.

3. The eyelash curler as in claim 2, wherein said power source:

comprises a battery; and said battery is contained within said handle.

4. The eyelash curler as in claim 3, wherein said concave surface comprises a non-stick material.

5. The eyelash curler as in claim 4, wherein said lever further comprises a switch connected between said battery and said heat element.

6. The eyelash curler as in claim 5, wherein said head assembly describes an angle with a major axis of said handle in the range of 5 degrees to 40 degrees.

7. The eyelash curler as in claim 6, wherein said heat surface moves in a direction substantially parallel to a major axis of said handle and longitudinally away from said handle.

8. The eyelash curler as in claim 6, wherein said heat surface moves in a direction substantially parallel to a major axis of said handle and longitudinally toward said handle.

9. The eyelash curler as in claim 6, wherein said convex surface comprises a non-stick material.

10. The eyelash curler as in claim 1, wherein said heat element is heated to a temperature in the range of 100 degrees F. to 120 degrees F.

11. The eyelash curler as in claim 3, further comprising:

a timing circuit;

said timing circuit connected between said switch and said heat element, said timing circuit being activated upon movement of said lever;

said timing circuit further comprising an audible tone emitter;

said audible tone being emitted upon expiration of a predetermined length of time.

12. The eyelash curler as in claim 11, wherein said timer circuit de-activates said heat element upon expiration of a pre-determined length of time.

13. The eyelash curler as in claim 3, wherein said battery is rechargeable.

14. The eyelash curler as in claim 12, wherein said timing circuit coincidentally de-activates said heat element upon the generation of an audible tone.

15. The eyelash curler as in claim 1, wherein said power source further comprises an electrical cord whereby said power source is connected to an electrical outlet.

16. An eyelash curler comprising:

a handle connected to a head assembly;

said head assembly comprising a lower heat jaw and an upper jaw, said lower heat jaw having a concave surface and said upper jaw having a convex surface cooperating with said concave surface in order to receive an eyelash therebetween;

said lower heat jaw and said upper jaw further describing a curve having a radius R, said radius oriented such that a concave aspect of said curve is directed toward a user's eyelash;

a tab contained within said handle and connected to said lower heat jaw;

said lower heat jaw moveable from an open position to a clamped position by application of a pressure by a user to said tab, whereby said tab is moved and said convex surface is pressed against said concave surface;

said lower heat jaw further comprising a heat element circuit connected to said tab and to a power source contained within said handle; and said heat element circuit activated by movement of said tab, wherein said heat surface is heated to a predetermined temperature.

17. An eyelash curler comprising:

a handle having a power source connected to a head assembly;

said head assembly comprising a clamp having a first clamp member and a second clamp member, said first clamp member having a concave surface and said second clamp member having a convex surface cooperating with said concave surface in order to receive an eyelash therebetween;

said first clamp member and said second clamp member further describing a curve having a radius R, said radius oriented such that a concave aspect of said curve is directed toward a user's eyelash;

a finger receiver contained within said handle and connected to said first clamp member;

said first clamp member moveable from an open position to a clamped position by application of a pressure by a user to said finger receiver, whereby said finger receiver is moved and said convex surface is pressed against said concave surface;

said first clamp member further comprising a heat element circuit connected to said finger receiver and to a power source contained within said handle; and said heat element circuit activated by movement of said finger receiver, wherein said heat surface is heated to a predetermined temperature.

18. The eyelash curler as in claim 16, wherein said power source:

comprises a battery; and said battery is contained within said handle.

19. The eyelash curler as in claim 17, wherein said power source:

comprises a battery; and said battery is contained within said handle.

20. The eyelash curler as in claim 19, further comprising:

a timing circuit;

said timing circuit connected between said switch and said heat element, said timing circuit being activated upon movement of said finger receiver;

said timing circuit further comprising an audible tone emitter; and said audible tone being emitted upon expiration of a predetermined length of time.

* * * * *